US007942421B1

(12) United States Patent
Franklin et al.

(10) Patent No.: US 7,942,421 B1
(45) Date of Patent: May 17, 2011

(54) CONTAINER WITH MESSAGE INSIDE AND RELATED METHOD FOR PROMOTING SOCIAL INTERACTION

(76) Inventors: Melanie Franklin, Greenwich, CT (US); Antony H. Lee, Greenwich, CT (US); Camilo E. Cucalon, Somers, NY (US)

( * ) Notice: Subject to any disclaimer, the term of this patent is extended or adjusted under 35 U.S.C. 154(b) by 956 days.

(21) Appl. No.: 11/285,662

(22) Filed: Nov. 22, 2005

Related U.S. Application Data

(60) Provisional application No. 60/630,486, filed on Nov. 23, 2004.

(51) Int. Cl.
*A63F 3/00* (2006.01)
*G09F 3/18* (2006.01)

(52) U.S. Cl. ..... 273/429; 273/161; 40/312

(58) Field of Classification Search ..... 273/272, 273/429, 430, 431, 432, 161; 428/7–9, 12; 446/77, 147, 148, 490, 310, 486; 206/232; 40/218, 310, 311–313, 459; 229/102.5, 116.1, 229/118, 125.37
See application file for complete search history.

(56) References Cited

U.S. PATENT DOCUMENTS 1,128,052 A * 2/1915 Roy ..... 206/45.29
2,160,488 A * 5/1939 Ringler ..... 229/108
2,644,259 A * 7/1953 Beadle ..... 40/312
2,672,273 A * 3/1954 Smith ..... 229/225
3,586,320 A * 6/1971 Mace ..... 472/54
4,889,238 A * 12/1989 Batchelor ..... 206/535
4,976,351 A * 12/1990 Mangini et al. ..... 206/232
5,234,726 A * 8/1993 Dahan ..... 428/9
5,497,876 A * 3/1996 Fleming ..... 206/232
5,558,272 A * 9/1996 Magister ..... 229/109
5,641,062 A * 6/1997 Burton et al. ..... 206/232
6,001,019 A * 12/1999 Al-Bannai ..... 472/54
6,047,820 A * 4/2000 Heinze, IIII ..... 206/232
6,279,909 B1 * 8/2001 Alexander et al. ..... 273/249
6,725,591 B2 * 4/2004 McLaughlin, Jr. ..... 40/660
6,726,572 B1 * 4/2004 Versen ..... 472/54
2006/0157956 A1 * 7/2006 Fukui ..... 280/287

* cited by examiner

*Primary Examiner* — William M Pierce

(74) *Attorney, Agent, or Firm* — R. Nell Sudol; Henry D. Coleman; William J. Sapone

(57) ABSTRACT

A kit for promoting social interaction includes a plurality of containers in the form of boxes held by a larger vessel. Each of the containers encloses a message designed for stimulating conversation and includes an instruction that the container is to be used for purposes of stimulating conversation. The instruction may be carried on the substrate together with the message. Alternatively or additionally, the messages may be provided on inside surfaces of the containers while the instruction may be printed on the outside of the individual containers.

10 Claims, 8 Drawing Sheets

FIG. 2
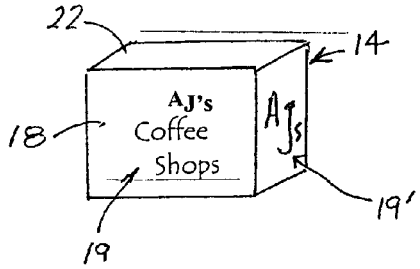
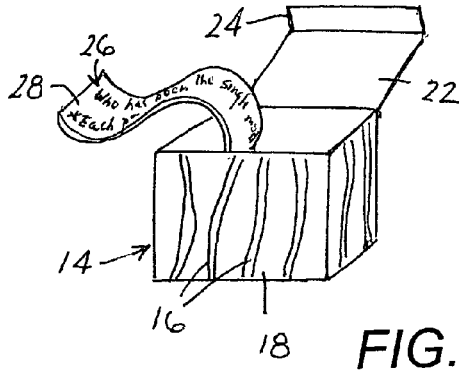
FIG. 4
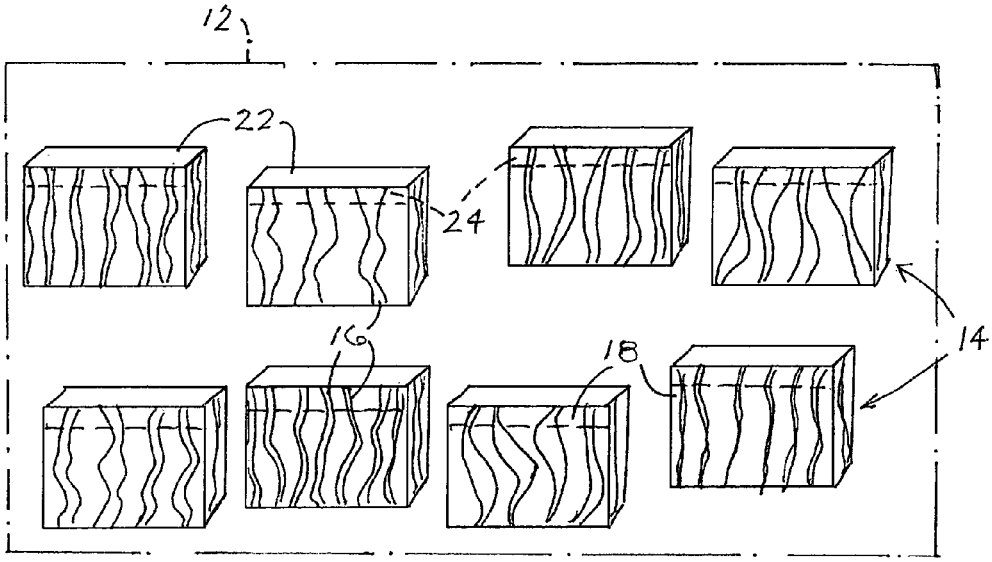
FIG. 1
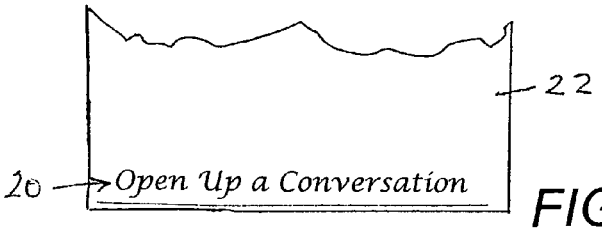
FIG. 3

Fig. 9
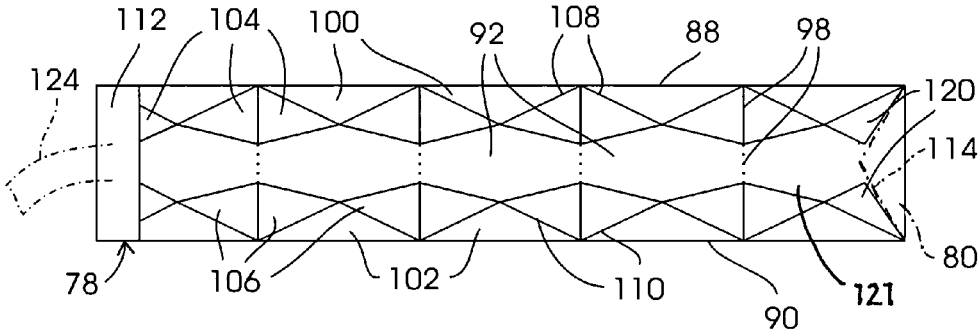
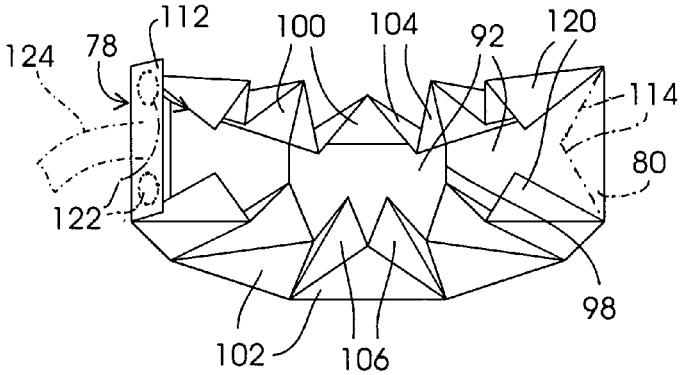
Fig. 10

CONTAINER WITH MESSAGE INSIDE AND RELATED METHOD FOR PROMOTING SOCIAL INTERACTION

CROSS-REFERENCE TO RELATED APPLICATION

This application claims the benefit of U.S. Provisional Patent Application No. 60/630,486 filed Nov. 23, 2004.

BACKGROUND OF THE INVENTION

This invention relates to a kit for promoting social interaction. More particularly, this invention relates to a kit for use in stimulating conversation. This invention also relates to an associated method.

Mealtimes have always been central in promoting social cohesiveness among a broad spectrum of different cultures. In modern societies, however, the exchange of ideas and conversation during family meal time has been in decline. Distractions have multiplied, reducing the time that people spend with one another at the table. This is especially frustrating for those who prepare the meals and would like to see more time spent over the fruits of their labors.

Increasing demands of work, as well as the proliferation of entertainment activities, have detracted from people's ability and willingness to participate in social intercourse.

SUMMARY OF THE INVENTION

The present invention aims to provide a product that would facilitate or enhance social interaction and, more specifically, that could be used to stimulate conversation. The product is ideally easy and enjoyable to use.

A kit for promoting social interaction comprises, in accordance with the present invention, a holder and a plurality of containers held by the holder, where each of the containers encloses a message designed for stimulating conversation and where each of the containers includes an instruction that the container is to be used for purposes of stimulating conversation. The present invention is also directed in part to an individual container that bears a message designed for stimulating conversation, the individual container including an instruction that the container is to be used for purposes of stimulating conversation.

The messages may be disposed on separate substrates inside respective ones of the containers. The substrates may be made of an at least partially resilient material so that the substrates are impelled out of the respective containers upon an opening thereof. The instruction may be carried on the substrate together with the message. Alternatively or additionally, the instruction may be printed on the outside of the individual containers. For example, where the containers are boxes, the instruction may be disposed on an outer surface of the boxes, for example, on lids of the boxes.

It is contemplated that the containers are made of an inedible material such as paper.

Pursuant to another feature of the present invention, the containers are provided with ornamental elements on outer surfaces thereof. The ornamental elements on the different containers may be coordinated from container to container to present a unified or singular appearance. This feature of the invention enables different collections of containers, i.e., different kits, to be distinguished from one another. For example, where different kits have different themes or have messages directed to different kinds of subject matter, a difference in appearance may communicate and differentiate content among the different kits. Different kits, for instance, might have messages directed to politics, entertainment, sports, travel, social issues, religion, investments and finance, foreign affairs, art, science, etc.

The ornamental elements may include graphics of different colors and shapes. The graphics may include corporate logos and other identifying marks. This potential identification technique is especially useful where restaurants, coffee and dessert shops, etc., use the kits. A coffee shop may, for instance, provide a few message-holding containers to customers who purchase coffee or other coffee-shop products for consumption by more than one individual.

The holder may itself take the form of a vessel such as a bag or box provided with decorative graphical patterns corresponding to the graphics on the containers.

In one embodiment of the present invention, the message includes an instruction to express an opinion. More particularly, the opinion is preferably about a subject about which reasonable people could have different views.

Where the instruction is provided inside the respective containers, the various containers in the kit may be additionally provided with a direction on an outer surface to open the respective container for purposes of stimulating conversation.

A game-type method for promoting social interaction comprises, in accordance with the present invention, providing to a group of people at least one container enclosing a message designed to stimulate conversation, instructing at least one of the people to open the container and read the message enclosed therein, and indicating to the group of people that each of them is to participate in a conversation on subject matter set forth in the message.

The providing of the container preferentially includes providing a plurality of containers each enclosing a respective different message designed to stimulate conversation, the one container being selected from among the plurality of containers.

The providing of the container, the instructing of the one of the people, and the indicating to the group may be performed during a meal, prior to or immediately after a termination thereof.

Where the container is provided at a food retail establishment, it may be given to a purchaser of food products for consumption by more than one person at the same time.

The indicating to the group that each of them is to participate in a conversation may include providing a written instruction as part of the tendered container. The container may hold a separate substrate carrying the message.

It is generally contemplated that the messages are disposable. Thus, after use, the messages are discarded so that new messages may be used to stimulate future conversation. Where the messages are on separate substrates, the substrates are discarded, while the containers may be recycled, i.e., provided with new message substrates. Where the message-bearing container is made of paper, it is contemplated that the entire container is discarded.

In one embodiment of the present invention, the conversation-stimulating container is an electronic device. Messages are stored in a digital memory and are either communicated aurally or visually in response to an activation of a request sensor by a user.

BRIEF DESCRIPTION OF THE DRAWINGS

FIG. 1 is a schematic perspective view, partially in phantom lines, of a kit in accordance with the present invention.

FIG. 2 is a schematic perspective view of an alternate design of a container or box includable in the kit of FIG. 1.

FIG. 3 is a partial top plan view of a container or box included in the kit of FIG. 1.

FIG. 4 is a schematic perspective view of a container or box of the kit of FIG. 1, showing the container in an opened configuration, with a strip of paper or other substrate issuing from the container.

FIG. 9 is a plan view showing the container of FIG. 8 is a partially folded configuration.

FIG. 10 is a plan view showing the container of FIGS. 8 and 9 in another partially, but more completely, folded configuration.

DETAILED DESCRIPTION

Figure 5:
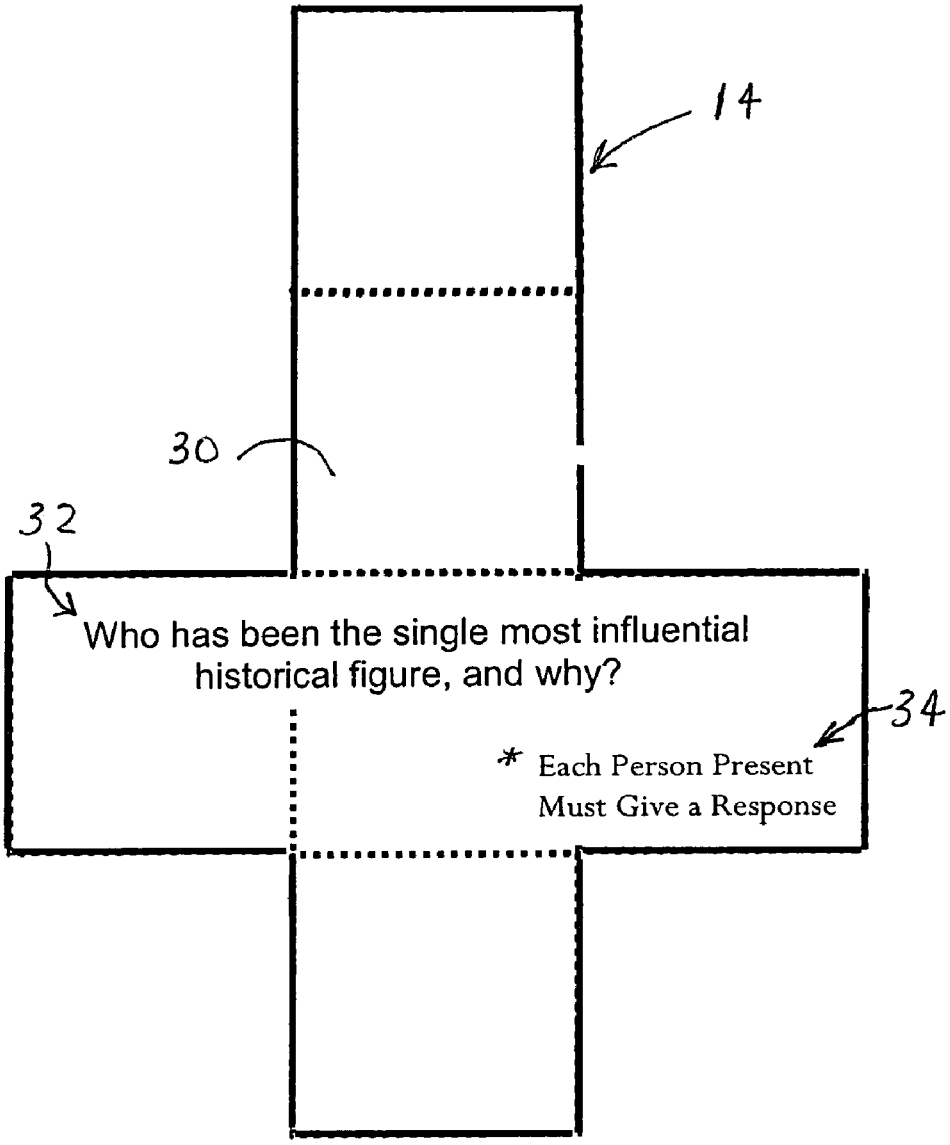
FIG. 5 is a plan view of a representative container of FIG. 1, showing the container in an unfolded configuration and particularly showing an inside surface of the unfolded container.

As depicted in FIG. 1, a kit for promoting social interaction comprises a holder or vessel 12, for instance, in the form of a bag, a chest, a box, etc. The kit further comprises a plurality of containers 14 exemplarily in the form of small paper boxes held by the vessel 12, for instance, for shipment, storage and in some cases presentation to users. Each container 14 defines a space inside (not separately labeled) and encloses a message with content designed for stimulating conversation. In addition, each of the containers 14 includes an instruction or direction that the container (and its contents) is to be used for purposes of stimulating conversation.

Containers 14 are made of an inedible material such as paper, fabric, or plastic.

Containers 14 are provided with ornamental elements 16 on outer surfaces 18 thereof. The ornamental elements 16 may differ from container to container 14 but may share visual characteristics such as style and color so that the ornamentation is coordinated among the containers 14 of a given kit to present a unified or singular appearance. FIG. 1 depicts ornamental elements 16 in the manner of streamers. The streamers may be accorded colors of a predetermined pallet to effect the visual coordination among the different containers 14. Vessel or holder 12 may be provided with geometrically and stylistically similar design or ornamental elements (not separately shown) to create a singular or unique appearance for the given kit. Of course, different kits may be provided with ornamental elements 16 of different shapes, colors, and meanings, to enable differentiation among the different kits in the marketplace.

As depicted in FIG. 2, ornamentation on the outer surfaces 18 of containers 14 may include a corporate name 19 or logo 19'. The placement of corporate logos 19, 19' on containers 14 can render the containers more attractive to companies or concerns such as restaurants, coffee shops, bars, tea houses, etc., to provide gratuitously to customers with orders for two or more people. Thus, customers who are meeting with other people at the restaurants, coffee shops, bars, tea houses, etc., are provided with a sociability-enhancing product together with their order.

As depicted in FIG. 3, the instruction or direction that containers 14 (and their contents) are to be used for purposes of stimulating conversation may take the form of a legend 20 such as "Open Up a Conversation" that is printed on outer surfaces 18 of containers 14, specifically on a lid 22. As shown in FIG. 1, lids 22 of containers 14 may be provided with an insertion flap 24 that facilitates maintenance of the lid in a closed configuration but also enables an easy opening of the lid so that a user may access the respective container 14.

As illustrated in FIG. 4, messages 26 provided in containers 14 for purposes of starting or stimulating social intercourse may be disposed on separate substrates 28 such as strips of paper or plastic inside the respective containers 14. Substrates 28 may be made of an at least partially resilient material so that the substrates are impelled out of the respective containers 14 upon an opening thereof. An instruction or direction that the containers 14 (and their contents) are to be used for purposes of stimulating conversation may be carried on substrate 28 together with message 26. Thus, each container 14 may include two such instructions or directions, one on the outside of the container 14 (e.g., 20) and one inside the container.

FIG. 5 schematically depicts a container 14 that is opened and unfolded to show an inner surface 30 on which is printed a content message 32 in the form of a query or instruction to express an opinion. The inner surface 30 of the container is also printed with an instruction 34 that the container (and more particularly message 32) is to be used for purposes of stimulating conversation. The instruction 34 takes the form of a direction that each person present must give a response to the query embodied in message 32.

Figure 6:
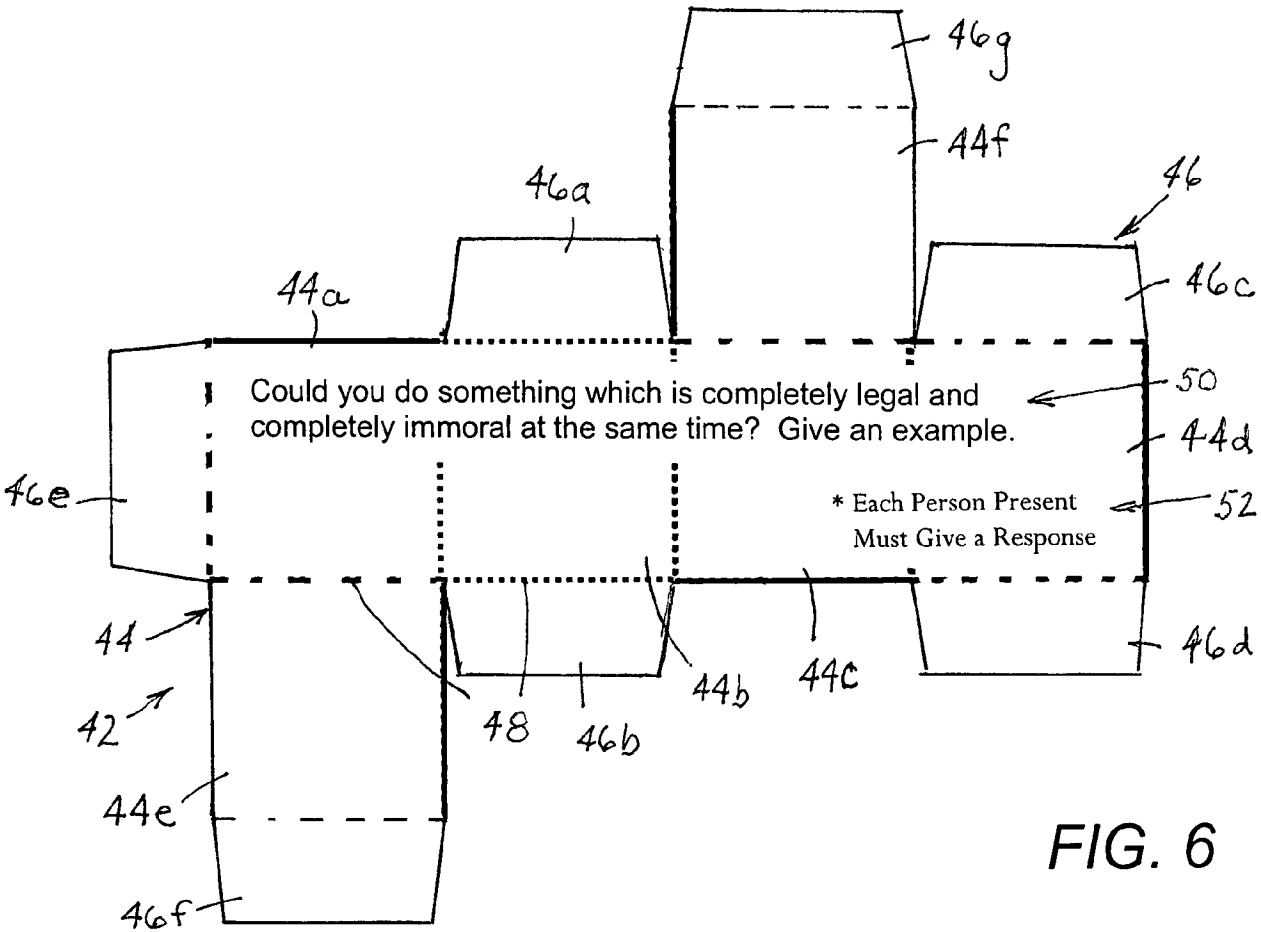
FIG. 6 is a view similar to FIG. 5, showing another representative container of FIG. 1, in an unfolded configuration with an inside surface visible.

Each container 14 of the kit shown in FIG. 1 may be formed from a respective blank 42 shown in FIG. 6 as a single or unitary web (not separately designated) including six square panels 44 and seven trapezoidal or tapered flaps 46 and provided with fold or score lines 48 (shown as dashed or phantom lines). Fold lines 48 and flaps 46 facilitate the formation of the cubic or box-shaped containers 14 by folding the blank 42 along fold lines 48 and inserting flaps 46 inside panels 44. More particularly, panels 44 include four panels 44*a*, 44*b*, 44*c*, 44*d* arranged in a linear array and two panels 44*e*, 44*f* disposed transversely to the linear array and respectively connected to panels 44*a* and 44*c* on opposite sides of the linear array. Flaps 46 include two pairs of flaps 46*a*, 46*b* and 46*c*, 46*d* connected to panels 44*b* and 44*d*, with the members of each pair extending in opposed directions from the linear array 44*a*, 44*b*, 44*c*, 44*d*. Flaps 46 further include three terminal flaps 46*e*, 46*f*, 46*g* connected to free ends of panels 44*a*, 44*e*, and 44*f*, respectively.

As shown in FIG. 6, each blank 42 may be printed on an inside surface (not separately labeled) with a query or statement or other message 50 about which individuals in a social group are invited, exhorted, commanded, cajoled, or directed to speak by means of an instruction or direction 52 also printed on the inside surface of the blank 42. As discussed above with reference to FIG. 4, the message 50 may be printed on an insert such as a strip of paper that is inserted inside the container after blank 42 has been folded and assembled to form the container and prior to a closure of a panel 44*e* or 44*f* that may serve as the lid of the container.

Preferably, the messages or queries 26, 32, 50 disposed inside containers 14 are drawn to subjects about which people could reasonably have different views. In other words, the topics of conversation as embodied in the messages or queries 26, 32, 50 have no right and wrong answers.

Ornamental elements 16 on outside surfaces 18 of containers 14, and optionally on the outside surface of holder or vessel 12, enable different kits to be distinguished from one another. For example, where different kits have different themes or have messages or conversation topics directed to different kinds of subject matter, a difference in appearance may communicate and differentiate content among the different kits. Different kits, for instance, might have messages directed to politics, entertainment, sports, travel, social issues, religion, investments and finance, foreign affairs, the arts, science, etc.

The conversation-stimulating kit as described hereinabove is useful in a game-type method for promoting social interaction. The entire kit, or perhaps an arbitrary subset of containers 14, is provided to a group of people who are engaged in a social circumstance. Typically, but not necessarily, one person of the group selects one container 14 from the kit or the provided subset of containers and opens the container to reveal the message pertaining to a topic of conversation. This activity may be undertaken in response to a direction from a host or a chairperson or may happen spontaneously where the kit or subset of containers 14 is placed in plain view. The one person might then read the message to the group. Subsequently, each person in the group presents, generally in succession, his or her opinion or view in response to the message. Of course, conversation may be expected to continue on the selected topic after everyone has had a chance to speak. When the conversation slows down or reaches an impasse, another container may be selected by the same or a different individual of the group to initiate another round of people expressing their opinions. The instruction that each person is to respond to the conversation-starting message may be communicated at the beginning of the discussion or when one or more parties fail to participate.

This game-type method for promoting social interaction may be carried out during a meal, prior to or immediately after a termination thereof. Accordingly, the method may be carried out in homes, restaurants, bars, coffee shops, etc., or in other social circumstances such as at parties. As discussed above, where one or more containers 14 are provided at a food retail establishment, it may be given to a customer who is purchasing food products for consumption by more than one person at the same time. (There is a reduced benefit in providing conversation starters to individuals in isolation.)

Examples of messages 26, 32, 50 disposed inside containers 14 are as follows:

- Who has been the single most influential historical figure, and why?
- You have been given the responsibility to distribute 20 billion dollars to help the world become a better place. Your task is to convince your table companions that the manner in which you propose to distribute the money would be the most effective in achieving that aim.
- While parking late at night, you slightly scrape the side of a Porsche. You are certain no one else is aware of what happened. The damage is minor and would not be covered by insurance. Would you leave a note?
- Could you do something which is completely legal and completely immoral at the same time? Give an example.
- Would you fight harder for a person's right to say whatever they liked, or for another person's right to be protected from racism or bigotry?
- Is there such a thing as right and wrong? Is it subjective by country, culture or religion, or is there a universal code of ethics and morals that should be observed?
- Your boss invites you out to lunch. After eating a salad he is unaware that there is a piece of lettuce lodged between his/her two front teeth. Do you say anything to him/her?
- If you could be invisible for a day and could travel anywhere you wanted, where would you go and what would you do?
- At the Christmas party held at your boss's house, you accidentally spill red wine on a precious Oriental rug. No one sees it happen. What do you do?
- You go to a friend's wedding and put your present on a large table with lots of others. You never receive a thank you note or any form of acknowledgement. Do you say anything?

Examples of content messages or conversation topics 26, 32, 50 for a kit directed to the specialized arena of the arts are as follows:

- Who is the greatest sculptor, living or dead, and what are your reasons?
- What is the purpose or function of art?
- Is there a difference between art and great art?
- Should artists be accorded greater respect for their opinions than, say, politicians or lawyers?
- Music is the greatest art form. Agree or disagree and why?

Examples of content messages or conversation topics 26, 32, 50 for a kit directed to the specialized arena of religion are as follows:

- Is religion the opiate of the people? Why or why not?
- Are religious truths necessarily incapable of proof? Why or why not
- Isn't it true that people for the most part believe what their parents believe?
- Buddha was more of a pacifist than Jesus. Agree or disagree and why not?
- Have religions have done more harm than good?

Examples of instructions disposed inside containers, proximately to the content message either on a separate substrate inside the container or on an inside surface of the container:

- Each person at table should give a response.
- Each person present must give a response.
- Whoever fails to give a response must give five dollars to each other person present.
- No dessert for anyone who does not reply.

The topics for conversation starter messages 26, 32, 50 are developed initially through research using multiple sources of information (such as interactions with others, reference books, new media, Internet sites, and any other reference material relevant to the goals). The raw material is studied, analyzed, edited and developed into unique, interesting and thought provoking topics of discussion or conversation that are then organized into a number of predetermined categories. Conversation starter messages 26, 32, 50 may take the form of questions or statements, written in sentences or paragraphs. The resulting product then becomes part of a database, which in turn, is used to feed the "delivery process.

The delivery process consists of the following steps: topics are delivered (electronically transmitted) to a printer who prints the sentences/paragraphs on large sheets of card stock (which have been designed and selected by category) in predetermined patterns. Once printed, the sheets are dye-cut into performs such as blank 42, folded and assembled into cubic containers 14 measuring one inch by one inch by one inch. The resulting containers or boxes 14 have a colorful category-driven exterior (ornamental elements 16), with the actual topic or message 26, 32, 50 printed on the inside.

Once containers or boxes 14 have been produced, they are packaged in holders or vessels 12. Holders or vessels 12 may come in a variety of ways and quantities: paper or fabric bags, cardboard boxes, glass or ceramic bowls, and any other "receptacle" that would allow for the transportation and display of containers or boxes 14.

The above-described development and manufacturing processes are conducted in a continuous manner so that the topics are always fresh and the delivery mechanisms evolve to meet users' expectations.

Figure 7:
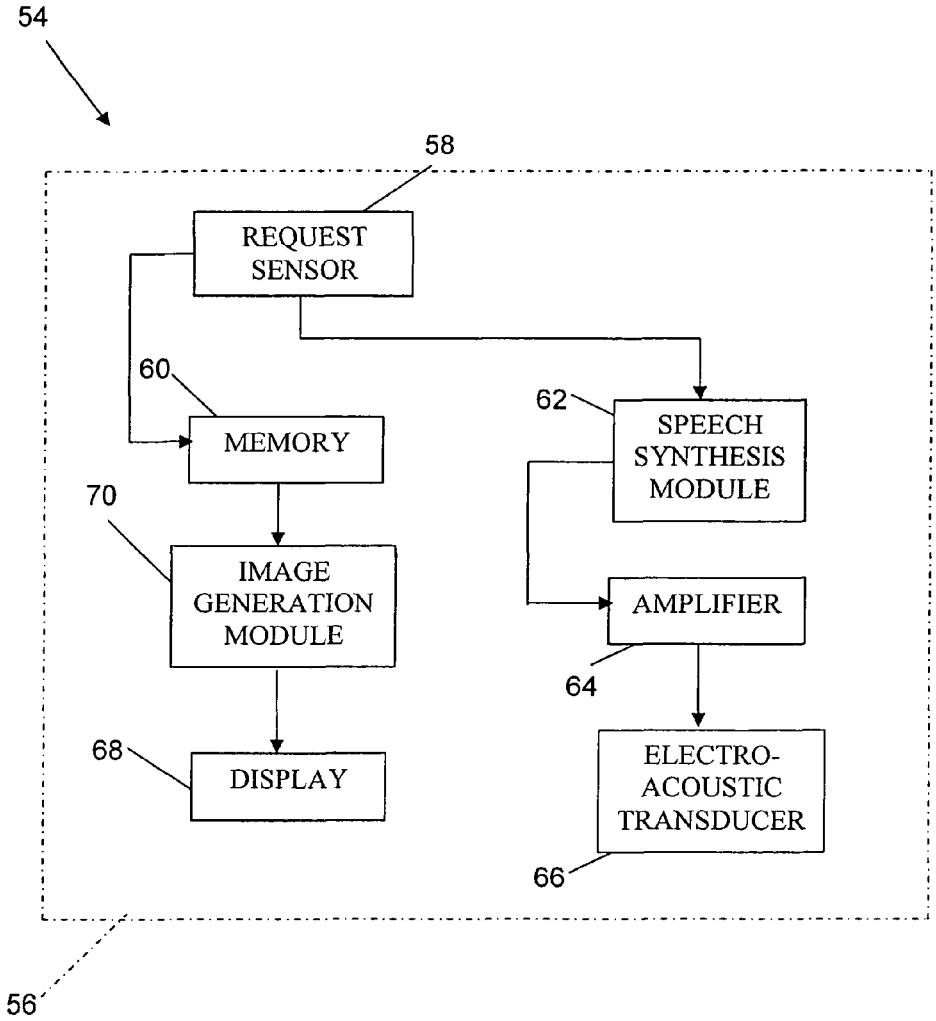
FIG. 7 is a block diagram of an electronic conversation-stimulating box in accordance with the present invention.

As depicted in FIG. 7, an electronic conversation-stimulating device 54 pursuant to principles disclosed hereinabove comprises a physical container 56, which may take the form of a box, holding conversation-starting messages in a digital memory 58. The device 54 includes a request sensor 60 for detecting when a user wishes to access memory 58 for purposes of obtaining a conversation starting message or topic stored therein. Sensor 60 may include a pushbutton, keypad, touch screen, acousto-electric transducer (microphone), switch, photocell, infrared detector, ultrasonic wave detector, or other energy-sensitive element for determining that a user has addressed the container 56 in some way to induce the communication of a message stored in memory 58.

Sensor 60 is connected to memory 58 for inducing the memory to select a message for aural communication via a speech-synthesis module 62, an amplifier 64, and an electro-acoustic transducer 66. Alternatively or additionally, memory may be connected to a display 68 via an image generation module 68 for providing a message in readable form. Sensor 60 may include multiple energy-sensing capability, for example, in the form of the different buttons of a keypad or a voice-recognition unit for detecting different verbal instructions, to provide users with some ability to select the general content of a message to be accessed (e.g., politics, entertainment, the arts, science, religion, etc.) or the form of the message (visual, aural, combination).

Messages stored in memory 60 are accessed or read out in a random or partially random manner. In a case of partially random accessing, messages may be stored in groups according to general content, as indicated above. The accessing of messages within such a group is random. The randomness may be accomplished by simply storing the messages in memory 58 in a random order.

Figure 8:
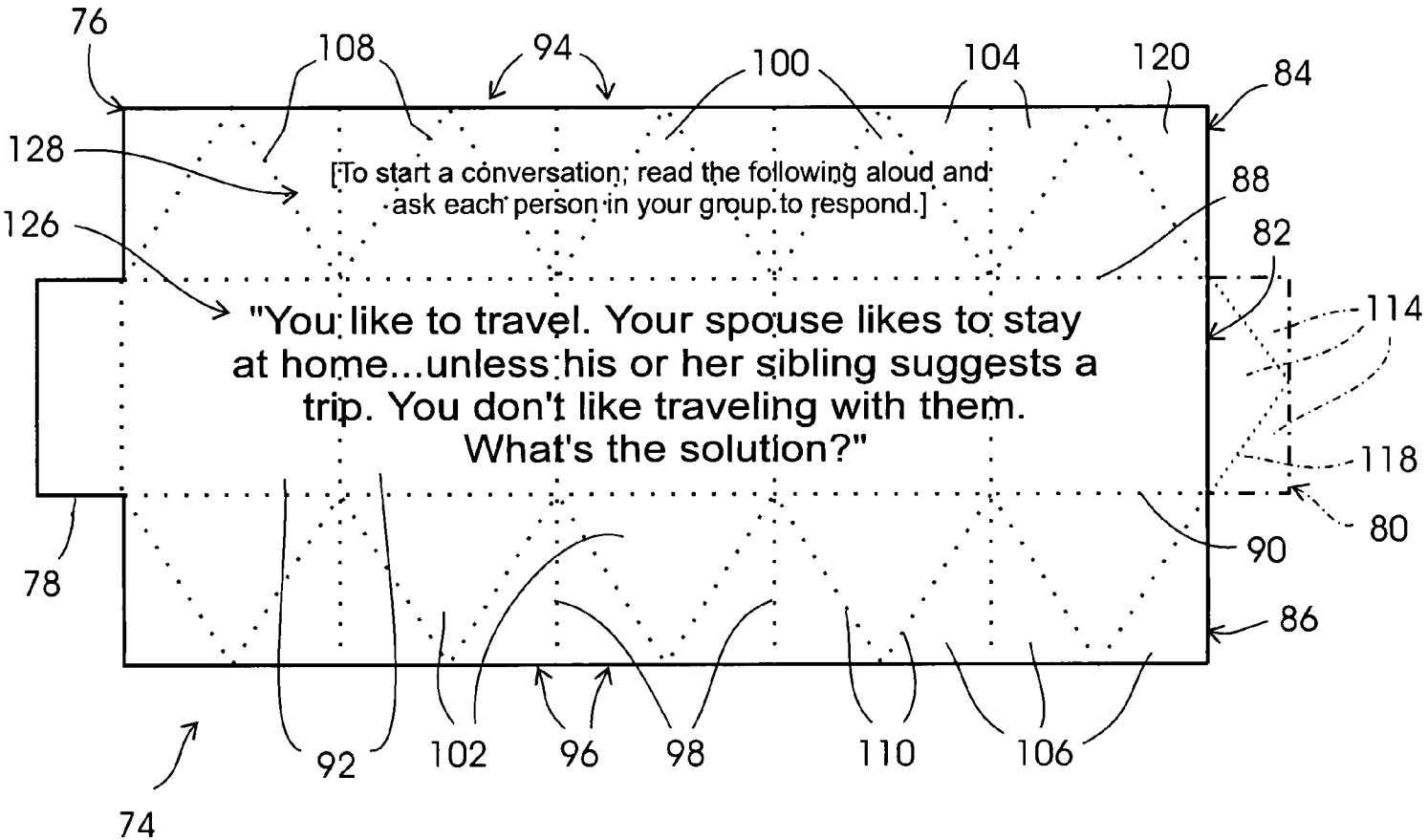
FIG. 8 is a plan view showing an unfolded configuration of another alternative container that may be included in the kit of FIG. 1, showing fold lines in dotted line format.
Figure 11:
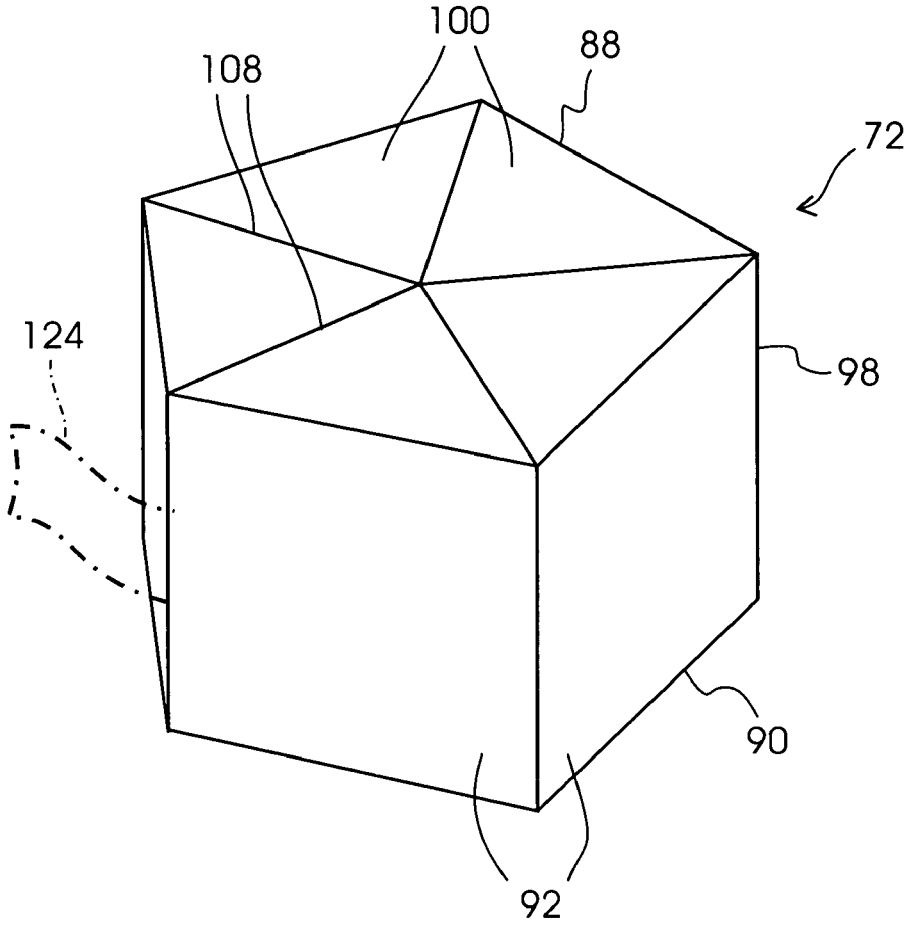
FIG. 11 is a perspective view, on a larger scale, showing the container of FIGS. 8-11 in a completely folded configuration.

The kit shown in FIG. 1 may alternatively comprise a plurality of containers 72 (FIG. 11) in the form of pentagonal prisms each formed from a respective blank 74 shown in FIG. 8 as a single or unitary rectangular web 76 provided at one end with a rectangular closure tab 78 and optionally at an opposite end with another rectangular closure tab 80. Main web 76 is divided into an elongate central area 82 and a pair of elongate flanking areas 84 and 86 by a pair of longitudinal parallel fold or score lines 88 and 90. The three elongate longitudinal areas 82, 84 and 86 are in turn each divided into five square sections collectively and respectively designated 92, 94, and 96 by transversely extending fold or score lines 98. Square sections 94 and 96 of flanking areas 84 and 86 are each in turn subdivided into an outwardly pointing triangular central panel 100 and 102 and two inwardly pointing triangular side panels 104 and 106 by angled fold or score lines 108 and 110. Optional closure or connection tab 80 may be subdivided into three triangular panels 114 by fold or score lines 118.

As depicted in FIGS. 9 and 10, blank 74 is folded along the longitudinal fold lines 88 and 90, transverse fold lines 98, and angled fold lines 108 and 110 so that: (1) central square sections 92 are collectively disposed in a pentagonal configuration, (2) triangular central panels 100 of square sections 94 are contiguous with one another in the manner of pie slices in a plane (FIG. 11) oriented substantially perpendicularly to square sections 92, thereby collectively forming a pentagonal upper face (not separately designated) of the completely folded container 72, (3) triangular central panels 102 of square sections 96 are contiguous with one another in the manner of pie slices in a plane parallel to the plane of triangular sections 100, thereby collectively forming a pentagonal lower face (not shown) of the completely folded container 72, and (4) triangular side panels 104 and 106 are angled inwardly into the container 72 and generally not visible from outside the container. In addition, to close the container 72, closure tab 78 is inserted in an unfolded configuration between inwardly folded triangular side panels 120 and a square section 121 at the opposite end of central area 82. If optional end tab 80 is provided, it is folded along score lines 14 and inserted between square section 121 and triangular side panels 120. One or more spots of adhesive 122 may be used to releasably cement tab 78 to square section 121 or tab 80. In addition, one or more ribbons or other opening tabs 124 may be connected to tab 78 (and/or tab 80, if provided) to facilitate the opening of container 72.

As shown in FIG. 8, each blank 74 may be printed on an inside surface (not separately labeled) with a query or statement or other message 126 about which individuals in a social group are invited, exhorted, commanded, cajoled, or directed to speak by means of an instruction or direction 128 also printed on the inside surface of the blank 74. As discussed above with reference to FIG. 4, the message 126 may be printed on an insert such as a strip of paper that is left inside the container 72 after blank 74 has been folded and assembled to form the container.

Again, the outer surface (not separately designated) of container 72 may be provided with suitable ornamentation and designs.

Figure 12:
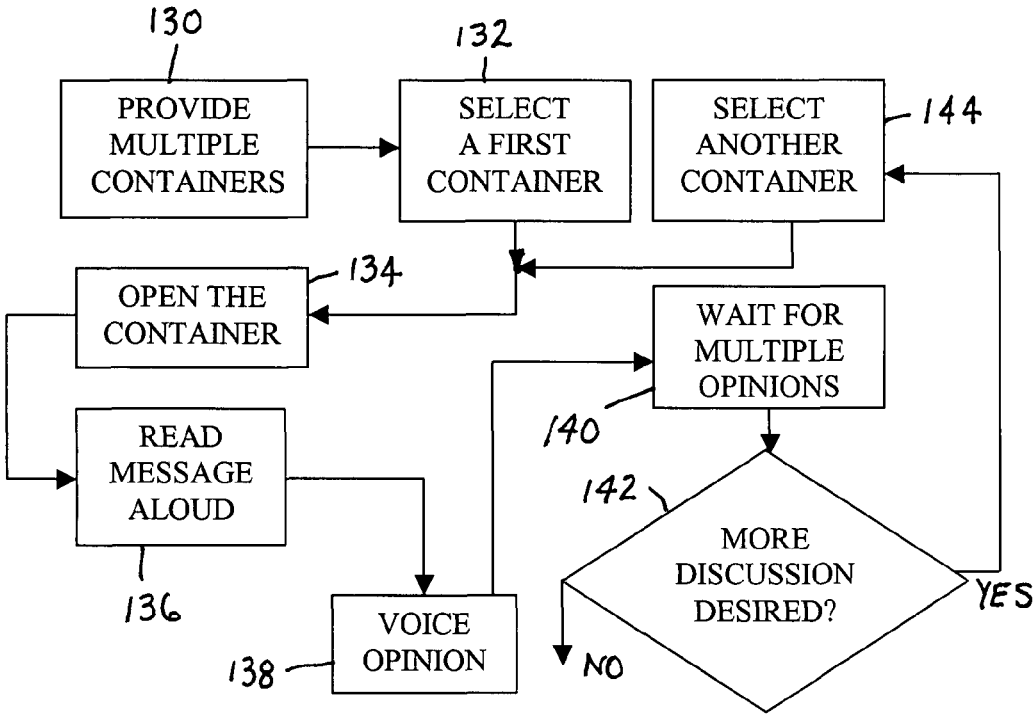
FIG. 12 is a flow chart diagram showing steps in a method utilizing the kit and containers of FIG. 1.

As depicted in FIG. 12, a game-type method for promoting social interaction comprises providing in a step 130 a plurality of containers 14 (FIG. 1), at least one of the containers 14 holding a message designed to stimulate conversation, the message identifying a subject matter and including a written instruction, exemplarily in the form of a question, to express an opinion on the subject matter for which there is no right or wrong opinion. The method further comprises selecting, in a step 132, a first container from among the plurality of containers provided in step 130 and opening the selected container in a step 134. In carrying out step 134, one transforms the selected container from a closed configuration to an opened configuration, to access the selected container to obtain the message held therein. In a subsequent step 136, one reads aloud the message from the opened container. Subsequently, in a step 138 one voices or verbalizes an opinion on the subject matter set forth in the message. One waits at a step 140 for further opinions to be voiced. At a subsequent decision junction 142, it is determined Whether further discussion (further expression of opinions) is desired. If so, another container 14 is selected in a step 144 and opened in step 134.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

The invention claimed is:

1. A game-type method for promoting social interaction, comprising:

providing at least one container holding a message designed to stimulate conversation, said message identifying a subject matter and including a written instruction to express an opinion on said subject matter for which there is no right or wrong opinion;

opening said container, thereby transforming said container from a closed configuration to an opened configuration, to access said container to obtain the message held therein;

reading aloud the message from the opened container; and voicing or verbalizing an opinion on said subject matter set forth in said message.

2. The method defined in claim 1 wherein the providing of said container includes providing a plurality of containers each enclosing a respective different message designed to stimulate conversation, said one container being selected from among said plurality of containers.

3. The method defined in claim 1 wherein the providing of said container, the opening of said container the reading of the message, and the conducting of said conversation are performed during a meal, prior to a termination thereof.

4. The method defined in claim 1 wherein the providing of said container is performed at a food retail establishment, the providing of said container including receiving said container from a seller of food products for consumption by more than one person at the same time.

5. The method defined in claim 1 wherein said container includes a written instruction separately from said message and as part of said container.

6. The method defined in claim 1 wherein said container holds a separate substrate carrying said message.

7. The method defined in claim 1 wherein said message includes an instruction to express an opinion.

8. The method defined in claim 1 wherein said message specifies subject matter about which reasonable people may have different opinions.

9. The method defined in claim 1 wherein said container is made of an inedible material.

10. The method defined in claim 1 wherein said container is a small box.

* * * * *